United States Patent [19]

Poole

[11] 4,248,541

[45] Feb. 3, 1981

[54] SERIAL PRINTER

[75] Inventor: Leonard A. Poole, Halland, England

[73] Assignee: International Standard Electric Corporation, New York, N.Y.

[21] Appl. No.: 4,182

[22] Filed: Jan. 17, 1979

[30] Foreign Application Priority Data

Jan. 19, 1978 [GB] United Kingdom ..... 02202/78

[51] Int. Cl.[3] ..... B41J 1/30

[52] U.S. Cl. ..... 400/144.2; 400/174

[58] Field of Search ..... 400/144.2, 144.3, 82, 400/174, 175, 134–134.6, 612

[56] References Cited

U.S. PATENT DOCUMENTS

| | | | |
|---|---|---|---|
| 665,402 | 1/1901 | Burry | 400/174 |
| 3,915,086 | 10/1975 | McManaman | 101/93.19 |
| 4,069,907 | 1/1978 | Isobe et al. | 400/144.2 |

*Primary Examiner*—Paul T. Sewell

*Attorney, Agent, or Firm*—A. Donald Stolzy

[57] ABSTRACT

To enable printing to be done in lines parallel to the edge of a record web as well as in lines perpendicular to the edge, a type-wheel is provided which has its slugs disposed at an angle, preferably 45°, to the radii through the centers of the slugs. Two hammer positions are also provided, one being positioned so as to produce the kind of lines first mentioned, and the other positioned to produce the kind of lines second mentioned.

4 Claims, 6 Drawing Figures

SERIAL PRINTER

BACKGROUND OF THE INVENTION

This invention relates to type-wheel printers.

SUMMARY OF THE INVENTION

In accordance with the printer of the present invention, two slugs are provided to print characters at respective perpendicular orientations.

BRIEF DESCRIPTION OF THE DRAWINGS

In the accompanying drawing which illustrates an exemplary embodiment of the present invention.

DESCRIPTION OF THE PREFERRED EMBODIMENT

Figure 1:
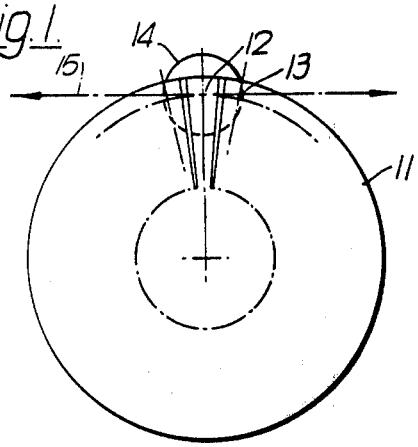
FIG. 1 is a side elevational view of the type slugs and print hammer in the print unit of a kind of type-wheel printer known as a daisy-wheel printer.

Up to now the type-slugs on the type-wheel of a daisy-wheel printer have been arranged equiangularly and spaced on a circle concentric with the center of the type-wheel and on a surface thereof perpendicular to the wheel's axis so that the vertical (that is, top-to-bottom) axis of each character coincides with the radius passing through the center of the slug. This arrangement is quite suitable for use where the information to be printed is displayed in one layout only, namely, like the page of a book, the lines of print running only across the width of the page, the width being less than the length of the page. This we shall refer to as normal layout. Such a print unit is shown in FIG. 1 where we are looking at a type-wheel, here shown as a daisy-wheel 11, from the hammer side.

The type-slugs 12 and 13 are on the opposite side so that the wheel is apparently transparent. The hammer 14 is shown dotted. The hammer 14 under control of a conventional print control unit, not shown, strikes petals of the daisy-wheel when they are at the top of the wheel's revolution and forces the slug against a record web and platen (not shown) so that the web is marked by the slug. In turn, the vertical axis of the slug and its mark are maintained perpendicular to the width of the web, or direction of traverse of the print unit indicated by the dashed line 15.

There are circumstances for example, where tabulation is required wherein the lines of print must be longer than the width of the web. With continuous stationary webs, rolled or folded, it is not feasible to reposition the web so that it feeds perpendicularly to the normal layout.

Figure 2:
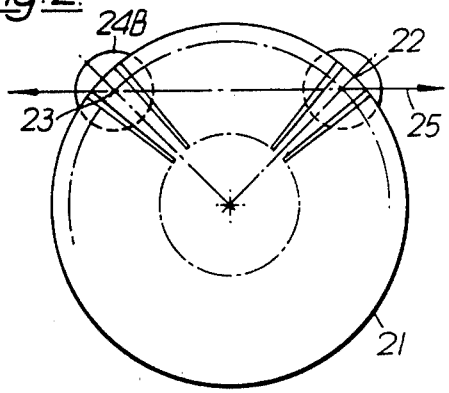
FIG. 2 is a side elevational view of the type-slugs and print hammers in a print unit of a daisy-wheel printer constructed according to the present invention.

In FIG. 2 a print unit is shown having a type-wheel, a daisy-wheel 21 (viewed from the hammer side) wherein type-slugs 22, 23 are so arranged on the petals of the daisy-wheel that their vertical axes are at an angle of 45° to the radial axes of the corresponding petals.

It can be seen that there is a first position during rotation of the wheel where the vertical axis of each type-slug is perpendicular to the width of the web, or direction of traverse of the print unit and dashed line 25. There is a second position, a quarter of a revolution of the daisy-wheel away from the first, where the vertical axis of each type-slug is parallel to the width of the web or direction of traverse of the print unit. There is a hammer 24A at a first hammer position, and a hammer 24B at a second hammer position, by means of which petals can be struck as required. Alternatively, there may be a single hammer movable to either the first hammer position or to the second hammer position.

Figure 3A:
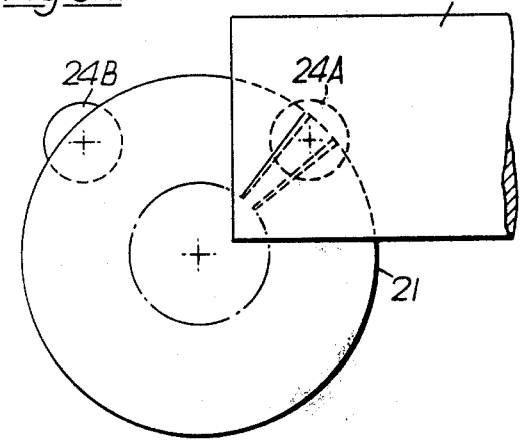
FIGS. 3A, 3B, 3C and 3D are views showing the print unit of FIG. 2 in relation to a printer platen for two different typing layouts.
Figure 3B:
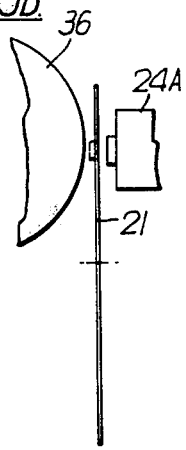
Figure 3C:
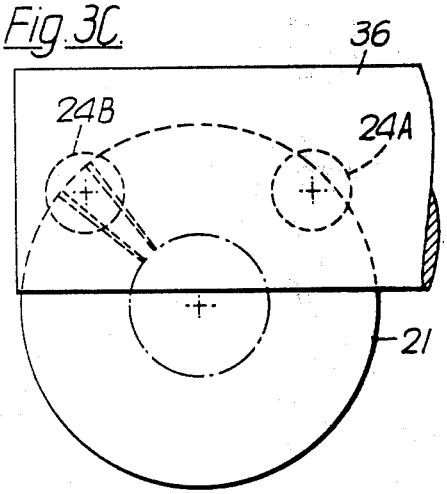
Figure 3D:
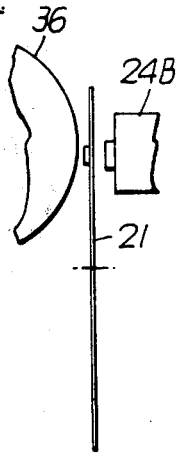

In FIGS. 3A and 3B the relation, for normal layout, of the daisy-wheel 21 and the hammer 24A to a platen 36 is shown, while in FIGS. 3C and 3D, the relation for perpendicular-to-normal layout, of the daisy-wheel 21 and the hammer 24B to the platen 36 are shown. It can be seen that there is a difference in the starting positions of the center of the daisy-wheel when commencing a new traverse across the platen, this difference being approximately 70 percent of the daisy-wheel diameter (more precisely the square root of 2, times radius of slug center).

We have shown in our drawing the normal layout being printed at the right-hand hammer position and the perpendicular-to-normal layout being printed at the left-hand hammer position. There is no reason why, mutatis mutandis, they should not be reversed. We have also shown the vertical axis of the slugs at 45° to the radial axis of the petals. Other angles are possible, but would lead to complication since the center of the daisy-wheel would also have to be movable perpendicularly to the direction of traverse of the print unit. At 45° a line through corresponding points in the two hammer positions is parallel to the direction of traverse of the print unit.

We have here given as an example a daisy-wheel printer, but the invention is also applicable to other type-wheel printers where the type-slugs are carried on a surface of the type-wheel perpendicular to its axis, and where type-slug and record web are brought together by a hammer blow whether the slug be movable relative to the wheel's center and driven towards the web or the slug be fixed relative to the wheel's center and the web driven towards the slug.

We have here only considered the mechanism of the print unit. A conventional printing control unit determines which hammer shall be used and the order in which characters to be printed are offered to the mechanism. Many printing control units associated with computer printout or with word-processing installations are already capable of manipulation of the order in which characters are offered. The angle of 45 degrees in each case may alternatively be equal to any angle $\phi$.

What is claimed is:

1. A printer comprising: a cylindrical platen having a horizontal symmetrical axis, said platen being adapted to receive a record sheet adjacent thereto on which characters may be produced; and a daisy-wheel having petals rotatable in a plane adjacent said platen and parallel to said axis, one of said petals having a first slug connected thereto with a first character thereon located in a place to cause a reproduction thereof on said record sheet and oriented in a first predetermined position to be vertical when said one petal is $\phi$ degrees from one side of a central vertical line through the center of said daisy-wheel in the plane thereof, another of said petals having a second character thereon located in a place to cause a reproduction thereof on said record sheet and oriented in a second predetermined position to be horizontal when said one petal is located in said first predetermined position, said other petal being positioned $\phi$ degrees from the other side of the same radial portion of said central vertical line, said first and second characters being spaced apart a distance and lying approximately on a transverse line parallel to said axis when said petals are the aforesaid $\phi$ degrees from said central vertical line.

2. The invention as defined in claim 1, wherein first and second hammers are provided to impact said first and second slugs selectively or simultaneously, said hammers being spaced apart the same distance as and in alignment with said first and second slugs on lines normal to said transverse line to cause said first and second characters carried thereby to imprint a likeness of each on said record sheet upon impact of said hammers against respective ones of said slugs.

3. The invention as defined in claim 2, wherein $\phi$ is equal to 45 degrees.

4. The invention as defined in claim 1, wherein $\phi$ is equal to 45 degrees.

* * * * *